United States Patent [19]

Valassopoulos et al.

[11] Patent Number: 4,957,428

[45] Date of Patent: Sep. 18, 1990

[54] PROCESS FOR CONSTRUCTING FURNACES WITH OPEN CHAMBERS, FOR AVOIDING DEFORMATION THEREOF

[75] Inventors: Aristide Valassopoulos, Aix en Provence; Jean-Claude Thomas, St. Germain en Laye; Christian Dreyer, St. Jean de Maurienne, all of France

[73] Assignee: Aluminium Pechiney, Paris, France

[21] Appl. No.: 327,703

[22] Filed: Mar. 23, 1989

[30] Foreign Application Priority Data

Apr. 8, 1988 [FR] France ..... 88 05251

[51] Int. Cl.[5] ..... F27D 7/00

[52] U.S. Cl. ..... 432/3; 432/191; 432/192

[58] Field of Search ..... 432/3, 1, 115, 85, 191, 432/192

*Primary Examiner*—Henry A. Bennet

*Attorney, Agent, or Firm*—Dennison, Meserole, Pollack & Scheiner

[57] ABSTRACT

A process as disclosed for constructing a furnace for open chambers for baking carbonaceous blocks, comprising arranging a plurality of chambers in a series or in two parallel series, each chamber being defined by lateral partitions and transverse partitions, disposing the plurality of chambers within an independent concrete casing formed by a floor and lateral wall portions having disposed thereof a plurality of vertical buttresses and compressively prestressing the vertical buttresses in the vertical direction. A horizontal force may also be applied to the upper part of the transverse partitions.

4 Claims, 3 Drawing Sheets

Figure 1:
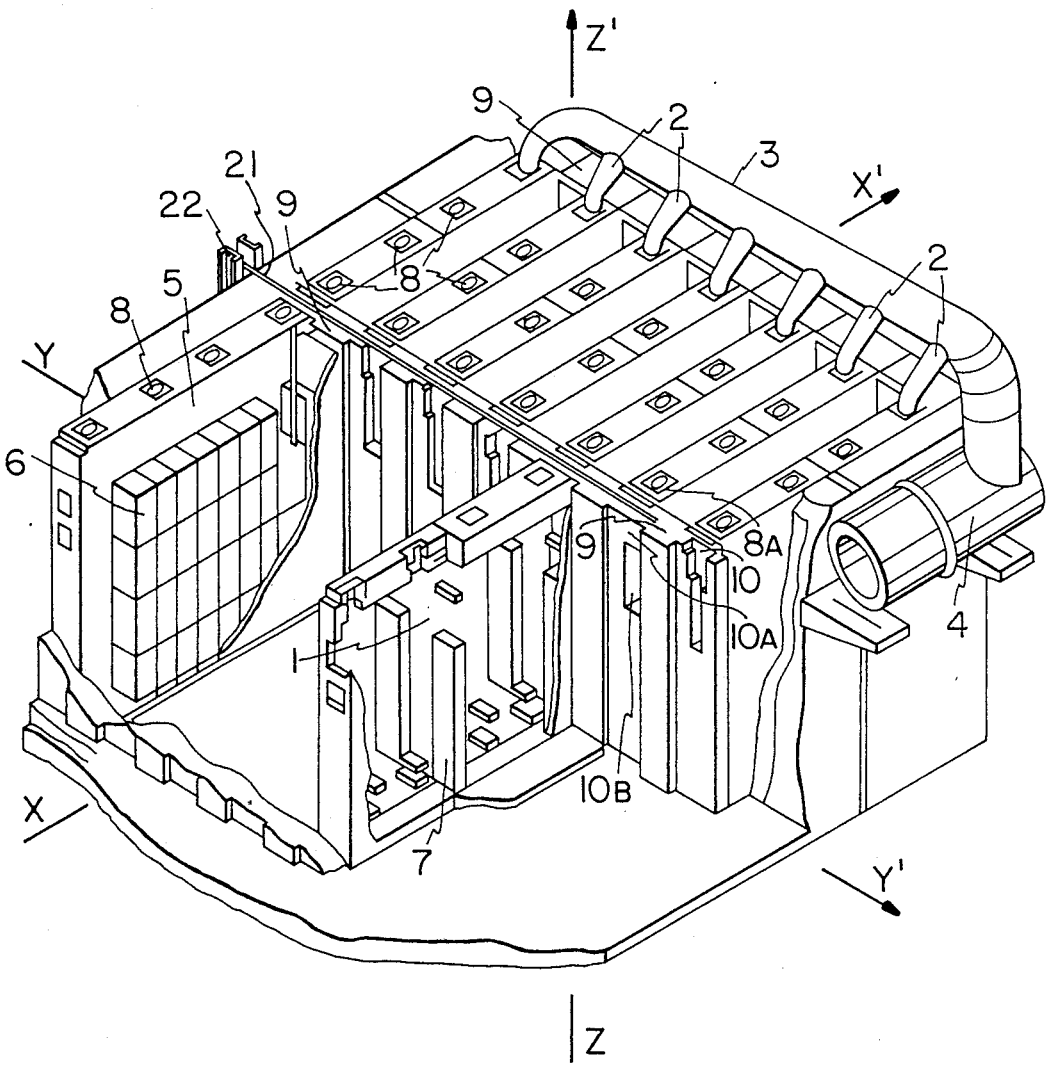

PROCESS FOR CONSTRUCTING FURNACES WITH OPEN CHAMBERS, FOR AVOIDING DEFORMATION THEREOF

TECHNICAL FIELD OF THE INVENTION

The invention concerns a process for constructing furnaces with open chambers, also referred to as "furnaces with rotating firing " or "furnaces with advancing firing ", which are primarily intended for baking carbonaceous anodes for the production of aluminum by electrolysis using the Hall-Heroult process.

STATE OF THE ART

That type of furnace generlly comprises two parallel banks, the total length of which may attain close to two hundred metres. Each bank comprises a succession of chambers which are separated by transverse walls and which are open in their upper part to permit loading of the raw anodes (or other carbonaceous blocks) and unloading of the cooled baked anodes. Disposed parallel to the long axis of the furnace, each chamber comprises an assembly of hollow partitions with relatively thin walls in which the hot gases producing the baking effect will circulate, the partitions alternating with cells in which the anodes to be baked are stacked, the anodes being embedded in a carbonaceous dust (coke, anthracite or any other powdery filing material). There are for example from 16 to 74 chambers and, per chamber, 7 heating partitions separating 6 cells. In the baking operation the maximum temperature attained is of the order of 1200° C.

The chambers in a bank are contained in a casing structure of concrete formed by a horizontal floor and two vertical wall portions. The concrete is protected from temperature, on the inward side, by thermal insulation. The whole of the furnace is accommodated in a building supporting the rolling tracks for the handling equipment.

Generally, when the level of the water table does not prevent it, the furnaces are buried or half-buried, which simplifies operation and handling and reduces the level of capital investment costs.

The walls of the concrete casing structure are subjected to three types of forces:

- a horizontal thrust force applied to the wall portions by the refractory material which forms the chambers, from the inside outwardly. Those stresses may attain a level of 400 kN per linear metre at the base of the wall portions.
- The thrust force due to the ground, by virtue of the embankment around the wall portions, that force acting in the opposite direction to the first thrust force, and
- a "bimetal " effect (differential expansion) of the buried half-buried floor and the wall portions, due to the temperature gradient in the thickness thereof.

The embankment around the walls means that the deformation phenomena cannot be directly observed, and reveal themselves in the long term in different ways, depending on the level and the type of embankment:

- in the case of buried furnaces, the wall portions deflect inwardly of the furnace, which interferes with the operations of handling anodes in the cells, by deforming the refractory material due to a compression effect; in that the case, the thrust force produced by the ground is preponderant;
- in half-buried furnaces, the thrust force of the refractory material predominates and the wall portions are deflected outwardly; that results in disorganisation of the brickwork which "spreads out " into the enlarged space, and the applicaiton of a force of greater or lesser magnitude to the building when the wall portions come into contact therewith, in particular at the locations of the posts supporting the metal frame structure.

The present invention seeks to remedy that situation.

SUBJECT-MATTER OF THE INVENTION

The subject-matter of the invention is therefore a process for constructing the concrete casing structure of a chamber-type furnace, which very substantially reduces the deformation phenomena due to differential thermal expansion between the different elements of the furnace and the thrust forces of all kinds which are applied to the walls.

More precisely the invention provides a process for the construction of a furnace with open chambers, which is intended for baking carbonaceous blocks and which comprises a plurality of chambers disposed in series in one or two parallel banks, each chamber being contained in a concrete casing structure formed by a floor and laterall wall portions of concrete, characterised in that disposed on the external face of each wall portion is a plurality of vertical buttresses which are prestressed in a vertical direction.

The prestressing is applied by means of at least one steel cable fixed at the two ends to a metal plate which bears against the base and the top of each buttress.

In addition the upper part of the transverse walls which separate the different chambers of the furnace from each other is held by means of a tie member to which an adjustable tension of between 0 and 200 kN is applied.

DESCRIPTION OF THE INVENTION

FIG. 1 to 6 illustrate the invention.

Figure 2:
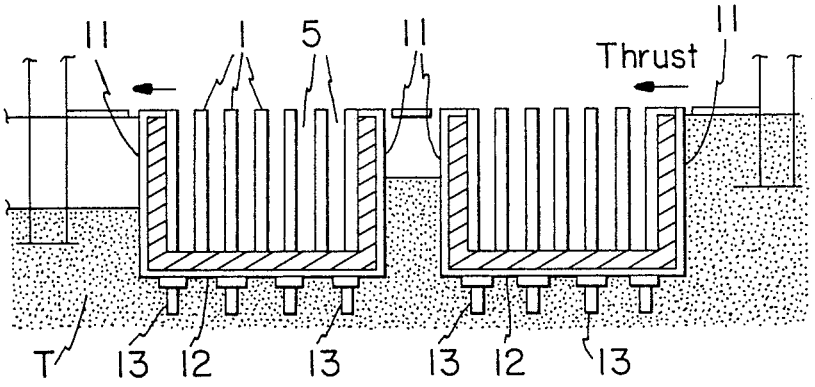

FIG. 1 recalls the structure of the chambers, cells and transverse walls, in order for the invention to be properly understood, FIG. 2 diagrammatically shows the direction of the main thrust force depending on whether the furnace is buried (at the right in FIG. 2) or half-buried (at the left).

Figure 3:
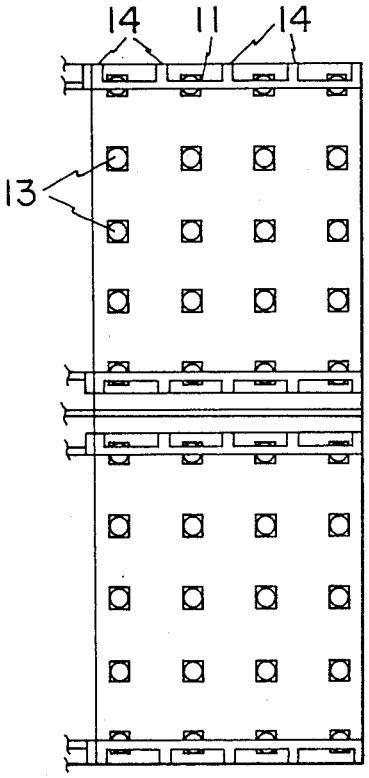
Figure 3A:
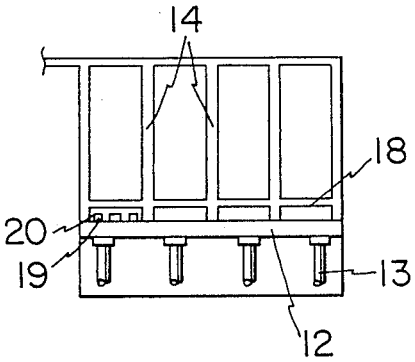
Figure 4:
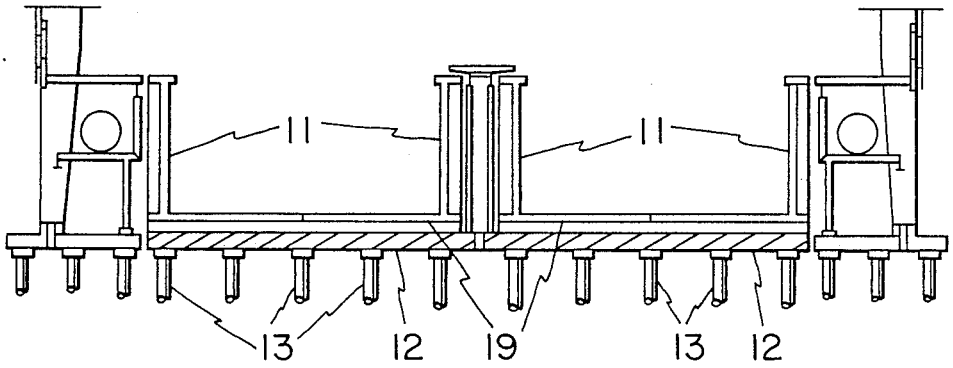

FIG. 3 is a diagrammatic view from above, supplemented by an elevational view in FIG. 3A and a view in cross-section in FIG. 4, of the construction of a casing structure of the furnace according to the invention.

Figure 5:
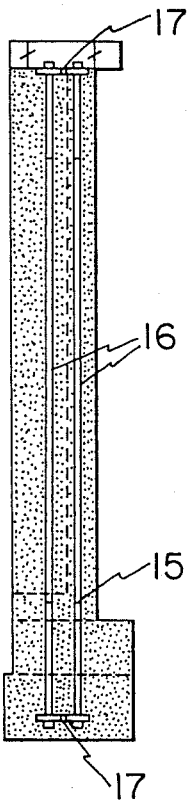
Figure 6A:
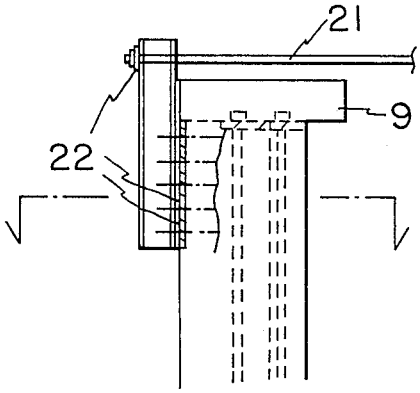
Figure 6B:
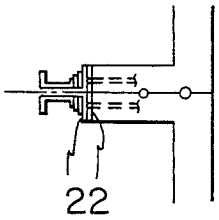

FIG. 5 shows the reinforcement effect achieved by prestressing the buttresses of the wall portions, and FIG. 6 shows the tensioning effect produced by a tie member in regard to the upper part of the transverse walls. Referring to FIG. 1, shown therein are the partitions 1 which are connnected in their upper part by delivery tubes 2 to the pipe 3 which is itself connected to the general manifold 4. The intake and blast pipes are connected to the port holes of the chambers, in accordance with our French patent No. 2 535 834 . Disposed in the cells 5 are the anodes 6 to be baked, which can be seen in the broken-away view in the left-hand part of FIG. 1.

The purpose of the baffle arrangements 7 of the heating partitions is to increase the length of the path of flow of the hot gases and to homogenize the temperture in partition. In the upper part of the chambers the holes 8 permit intake and blast pipes and burners to be set in position, in correlation with the advance movement of the firing effect. The successive chambers are separated by transverse walls 9. The successive partitions of the different chambers are communicated by means of opening 10 provided in the upper part of the transverse wall. The long axis of the furnace is indicated by the line XX'.

Referring to FIG. 2 which is a highly simplified view in cross section, shown therein in thickened lines are the concrete wall portions 11 which constitute the framework of the furnace, the framework being supported by a floor 12 resting on piles 13, the depth of which depends on the nature of the ground T.

In FIG. 3, 3A and 4, the wall portions 11 have been provided with external butresses 14 which are in a prestressed condition, in accordance with the invention.

As indicated in FIG. 5, the prestressing effect is produced by insertion over the entire height of the buttress of prestressing cables 15 which are encased with a protective sheath 16 which is injected after the cables have been put under tension, the cables being bolted at their two ends to plate 17 which bear against the top and bottom ends of each buttress 14.

To supplement the reinforcing effect in respect of the wall portions, it is possible to operate on the transverse walls 9. In fact, in the conventional design in respect of such walls, they are provided in their upper part with openings 10A intended to receive flaps which make it possible to establish or interrupt the circulation of combustion gases in the heating partitions 1 in dependence on the heating cycle.

If use is made of a closure device which is set in position within the partition, such as for example the extendable closure member being the subject-matter of our French patent applicaiton No. 87-08564 lodged on 9th June 1987 , it is then possible to eliminate the opening 10A in the transverse wall and to provide the communication between the chambers by means of an opening 10A which no longer constitutes a weak point in the wall and which can be closed off by means of the extendable closure member which is introduced by way of the closest opening 8A of the corresponding partition.

Under those conditions, as illustrated in FIG. 6, it becomes possible to put under tension the upper part of the wall 9, by means of at least one horizontally disposed tie member 21 which is anchored to two steel plates 22 which are disposed in such a way as to hear against the two ends of the wall 9.

The tension is adjustable between 0 and 200 kN by spring means and/or a Belleville washer or any other equivalent means.

EMBODIMENT

The invention was carried into effect upon reconstruciton of a chamber-type furnace comprising two parallel bays, of a total width of 25 meters.

The lateral wall portion 11 are 5 meters in height and 10 meters in length and are reinforced by 5 buttresses which are shown in FIG. 5 by means of two steel cables surrounded by a metal protective sheath. The prestressing force applied was set at 600 kN per cable.

The upper part of the transverse walls was put under tension by means of a metal tie member 21 which is adjusted in such a way that the maximum force which is applied when the firing array of the furnace passes same is equal to 140 kN.

After one year of uninterrupted operation, it was found that the maximum amount of movement of the wall portion in the upper part when the firing array of the furnace passed did not exceed 25 mm.

We claim:

1. A process for constructiing a furnace with open chambers for baking carbonaceous blocks, comprising arranging a plurality of chambers in a series or in two parallel series, each chamber being defined by lateral partitions and transverse partitions, disposing the plurality of chambers within an independent concrete casing structure formed by a floor and lateral wall portions having disposed thereon a plurality of vertical buttresses and compressively prestressing said vertical buttresses in the vertical direction.

2. A process according to claim 1, wherein said buttresses are prestressed by fixing at least one steel cable between metal plates located at each end of a buttress such that a metal plate bears against each end of a buttress.

3. A process according to claim 1 or 2, additionally comprising applying to the upper part of a said transverse partition a force in the horizontal direction which is adjustable between 0 and 200 kN.

4. A process according to claim 3, wherein said adjustable force is applied by disposing at least one metal tie member horizontally along the length of said transverse partition, anchoring said at least one tie member to said partition at each end of the partition, and placing said tie member under an adjustable tension.

* * * * *